US009394147B2

(12) United States Patent
Holtman

(10) Patent No.: US 9,394,147 B2
(45) Date of Patent: Jul. 19, 2016

(54) PORTABLE INDPENDENT VEHICLE LIFT AND SUPPORT SYSTEM

(71) Applicant: Gray Manufacturing Company, Inc., St. Joseph, MO (US)

(72) Inventor: Matthew W. Holtman, Conception Jct., MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 249 days.

(21) Appl. No.: 14/168,469

(22) Filed: Jan. 30, 2014

(65) Prior Publication Data

US 2014/0219768 A1 Aug. 7, 2014

Related U.S. Application Data

(60) Provisional application No. 61/759,844, filed on Feb. 1, 2013.

(51) Int. Cl.

| | |
|---|---|
| ***B66F 3/46*** | (2006.01) |
| ***B66F 3/24*** | (2006.01) |
| ***B66F 5/04*** | (2006.01) |

(52) U.S. Cl.

CPC . *B66F 3/46* (2013.01); *B66F 3/247* (2013.01); *B66F 5/04* (2013.01)

(58) Field of Classification Search

CPC ..... B66F 1/00; B66F 3/00; B66F 3/247; B66F 5/00; B66F 7/00; B66F 11/046

See application file for complete search history.

(56) References Cited

U.S. PATENT DOCUMENTS

| | | | | |
|---|---|---|---|---|
| 4,659,072 | A * | 4/1987 | De La Rosa | D04B 37/00 269/17 |
| 4,960,264 | A * | 10/1990 | Arzouman | B66F 5/04 254/8 B |
| 5,299,658 | A | 4/1994 | Cox et al. | |
| 5,372,353 | A * | 12/1994 | West | B25H 1/0007 254/10 B |
| 5,484,134 | A * | 1/1996 | Francis | B66F 7/04 254/2 B |
| 5,911,408 | A | 6/1999 | Berends et al. | |
| 5,992,824 | A * | 11/1999 | Voss | B66F 5/04 254/2 B |
| 6,991,221 | B1 | 1/2006 | Rodriguez | |
| 8,256,577 | B2 * | 9/2012 | Kritzer | B66F 3/46 187/215 |
| 2004/0026180 | A1 | 2/2004 | Baker | |
| 2012/0080579 | A1 | 4/2012 | Francis | |
| 2012/0080653 | A1 | 4/2012 | Gray et al. | |
| 2013/0240812 | A1 | 9/2013 | Helmich | |
| 2014/0219768 | A1 * | 8/2014 | Holtman | B66F 3/46 414/800 |

OTHER PUBLICATIONS

Search Report and Written Opinion dated Jul. 21, 2014 for copending PCT Patent Application No. PCT/US2014/013900, filed on Jan. 30, 2014; 11 pages.

* cited by examiner

*Primary Examiner* — Lee D Wilson

(74) *Attorney, Agent, or Firm* — Hovey Williams LLP

(57) ABSTRACT

An improved vehicle lift system is provided for lifting and supporting a vehicle. The vehicle lift system includes a portable front lift for lifting and supporting a front end of the vehicle, a portable rear lift for lifting and supporting a rear end of the vehicle, and a portable control station for remotely controlling the front lift and the rear lift from a safe and convenient location. The vehicle lift system may include hydraulics, pneumatics, electronics, and/or mechanical linkages for distributing and providing lifting power to the front lift and the rear lift.

34 Claims, 7 Drawing Sheets

PORTABLE INDPENDENT VEHICLE LIFT AND SUPPORT SYSTEM

The present application claims the priority benefit of U.S. Provisional Patent Application Ser. No. 61/759,844 entitled "PORTABLE INDEPENDENT VEHICLE LIFT AND SUPPORT SYSTEM" filed Feb. 1, 2013, the entirety of which is incorporated herein by reference.

BACKGROUND

Commercial vehicle fleet maintenance is performed in a variety of locations and shops that do not share common characteristics. There are many variables between these locations including ceiling height, overhead door location and the number, size, and configurations of the service bays. These shops are typically crowded and congested leaving limited working room around the vehicle(s) for "fixed type" lifting and support devices.

Portable vehicle lifts exist, which provide flexibility in positioning the vehicle. These lifts are deficient, however, inasmuch as they do not lift in a controlled and balanced manner, and they require a service technician to be near or partially under the vehicle when lifting the vehicle. Vehicles must be lifted in a balanced manner to ensure that one end of the vehicle is not lifted while the other end is stationary. Unbalanced lifting causes weight shifts, slipping, and unpredictable movement, which can cause injury or death to the service technician. Requiring the service technician to be near or partially under the vehicle when lifting the vehicle is undesirable because the lift is unsecured, meaning it can slip or fail, possibly causing the vehicle to fall on the service technician.

Existing portable vehicle lifts also provide little if any adaptability to commercial vehicle designs and geometries. Commercial vehicles often have a body that extends far below the vehicle frame, making positioning the portable vehicle lift under the vehicle without driving the vehicle onto a ramp and engaging the vehicle frame difficult. Often service technicians engage the frame after sliding the lifts under the body by placing spacer blocks on the lift. This is troublesome because the spacer blocks are not properly sized and because it adds instability to the lifts.

There is accordingly an unresolved need in the art for improved vehicle lifts.

SUMMARY

Embodiments of the present invention solve the above-described problems by providing improved independent portable lifts for lifting and supporting vehicles.

One aspect of the invention concerns a vehicle lift system having a portable front lift, a portable rear lift, and a portable control station. The portable front lift includes a front lift unit supported on a set of wheels. The portable rear lift includes a rear lift unit supported on a set of wheels. The portable control station controls the front and the rear lifts.

Another aspect of the invention concerns a vehicle lift having a plurality of spaced apart lift units, a support bar coupled to and extending between the lift units, and a plurality of spaced-apart vehicle engagement members coupled to and supported on the support bar. The vehicle engagement members are rotatable relative to the support bar on a substantially horizontal axis of rotation between a down configuration and an up configuration.

Yet another aspect of the invention is a portable vehicle lift unit including a lift base, a vertically extensible member coupled to the lift base and shiftable relative to the lift base between a retracted position and an extended position. The extensible member defines one or more lock-receiving recesses. The lift unit also includes a mechanical lock member coupled to the lift base and shiftable relative thereto between a locked position and an unlocked position. When the mechanical lock member is in the locked position, the mechanical lock member is received in a lock-receiving recess of the extensible member. The lift unit also includes an actuator for shifting the mechanical lock member between the locked and the unlocked positions, and a control system for automatically shifting the mechanical lock members into the locked position when the extensible member is in the extended position.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
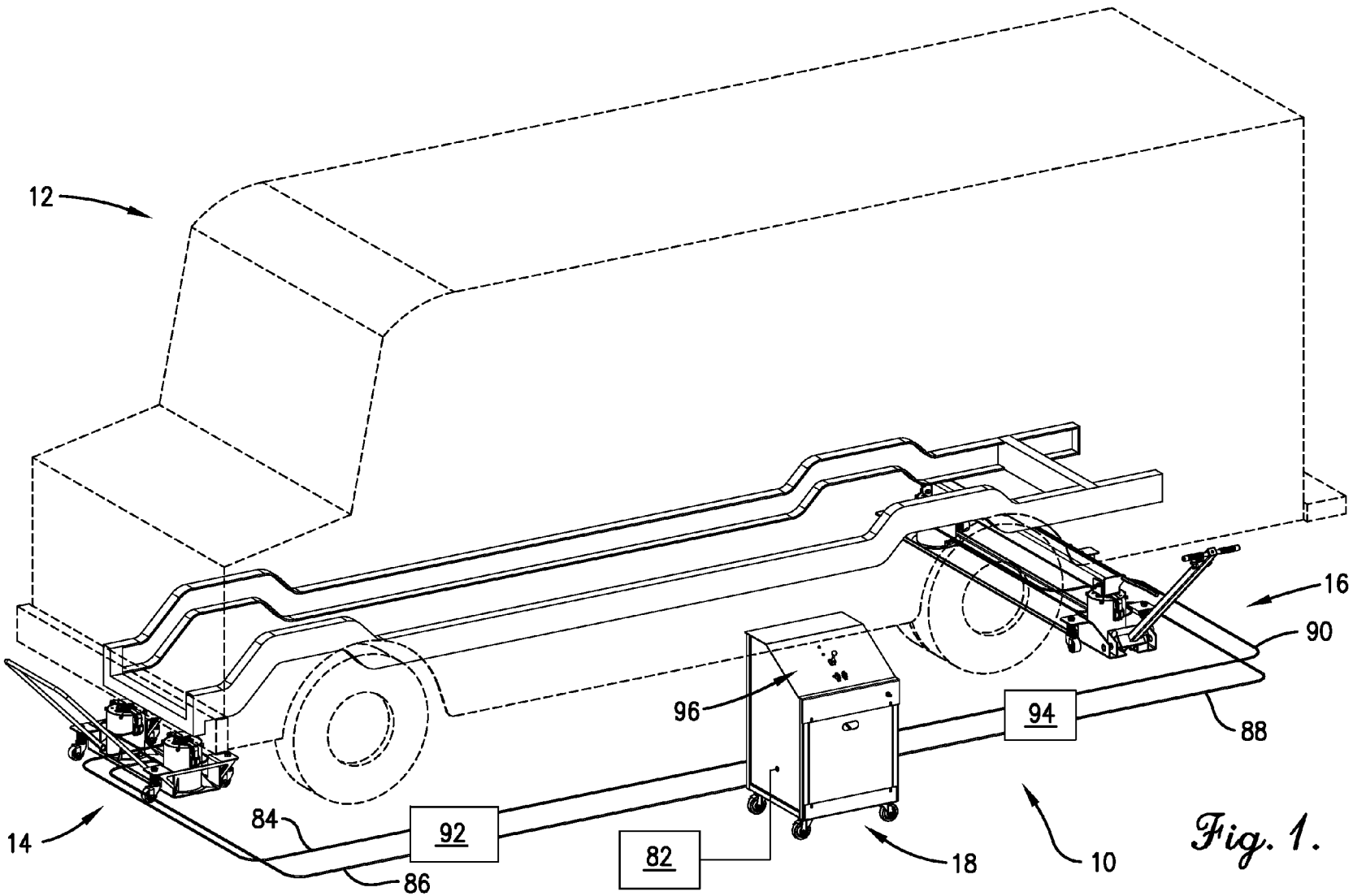
FIG. 1 is a perspective view of a vehicle lift system including a portable front lift, a portable rear lift, and a portable control station for lifting a vehicle, constructed in accordance with an embodiment of the invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning now to the drawings, a vehicle lift system 10 for lifting and supporting a vehicle 12 is depicted. Broadly speaking, the vehicle lift system 10 includes a portable front lift 14 for lifting and supporting a front end of the vehicle 12, a portable rear lift 16 for lifting and supporting a rear end of the vehicle 12, and a portable control station 18 for remotely controlling the portable front lift 14 and the portable rear lift 16 from a safe and convenient location, as shown in FIG. 1. The vehicle lift system 10 may include hydraulics, pneumatics, electronics, or mechanical linkages for distributing and providing lifting power to the portable front lift 14 and the portable rear lift 16.

Figure 2:
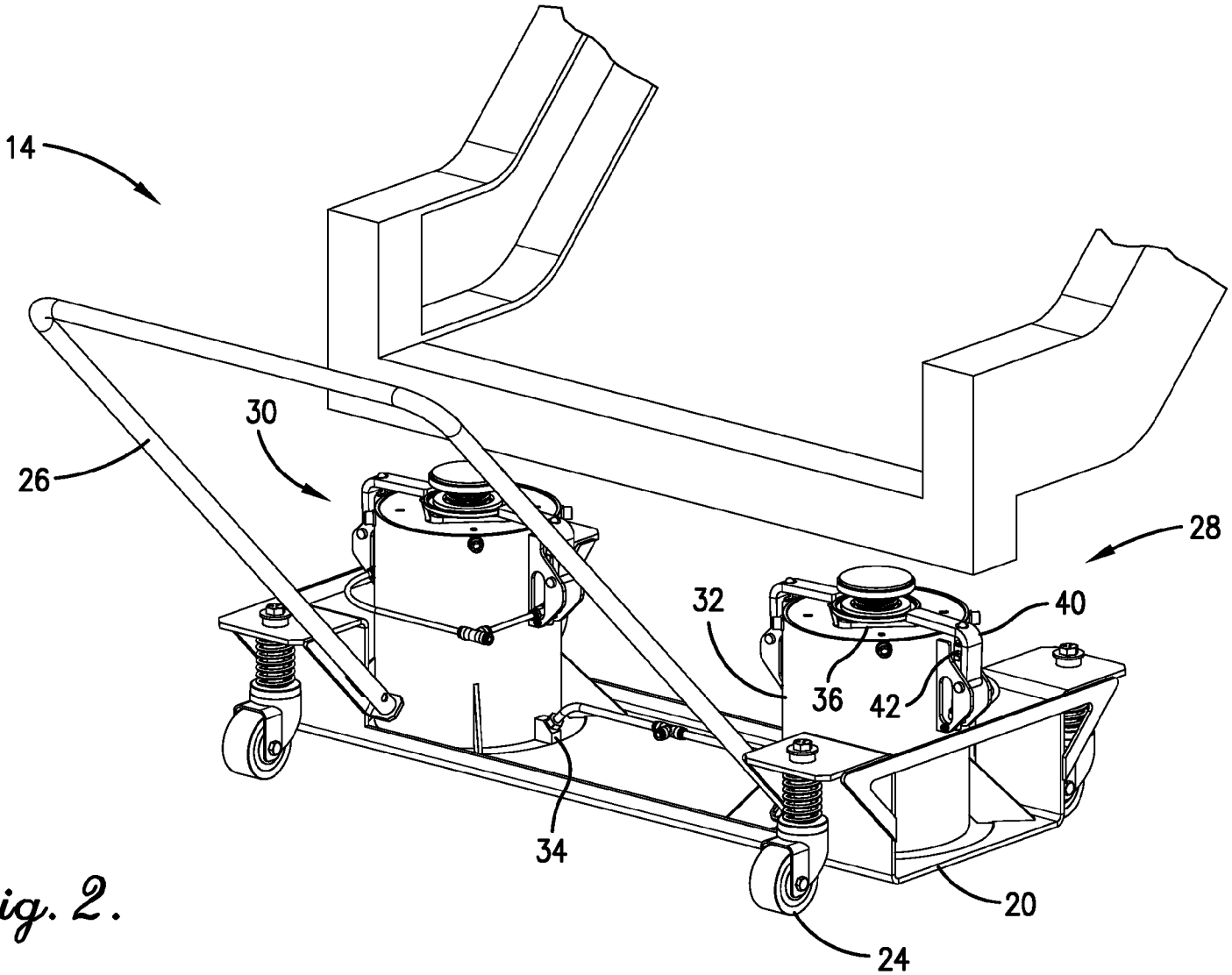
FIG. 2 is a perspective view of the portable front lift of FIG. 1 in a fully retracted position for positioning the front lift under a front end of the vehicle.
Figure 6:
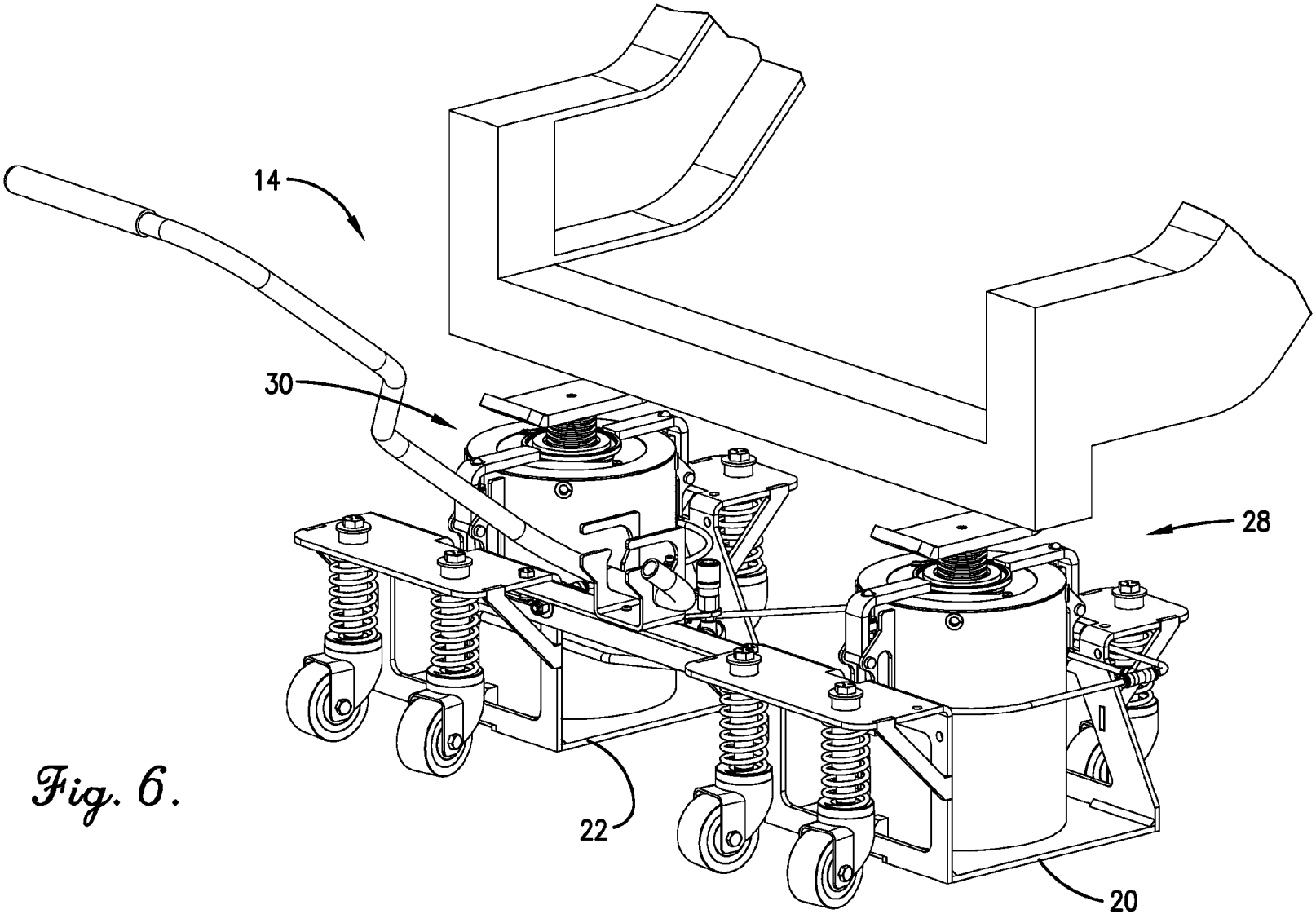
FIG. 6 is a perspective view of another embodiment of the portable front lift of FIG. 1.

As shown in FIGS. 2 and 6, the portable front lift 14 includes one or more base structures 20, 22 for easily moving the portable front lift 14 around a shop floor or other work space. The base structure(s) 20, 22 is supported by a plurality of wheels 24, such as castors, for easily positioning the portable front lift 14 in a proper position and orientation under the vehicle 12. The wheels 24 may be shiftable from a deployed position to a non-deployed position, so that the base structure(s) 20, 22 rests firmly on the shop floor during vehicle lifting. This allows the base structure(s) 20, 22 to provide a sturdy and safe lift point for raising and lowering the vehicle 12. The wheels 24 may be urged towards the deployed position by springs or another biasing mechanism. Thus, a force generated by the biasing mechanism must be overcome to shift the wheels 24 to the non-deployed position. The wheels 24 may be locked in the non-deployed position when the vehicle 12 is being lifted. When the wheels 24 are unlocked, the biasing mechanism urges the wheels 24 to the deployed position. The portable front lift 14 may also include a handle 26 for easily pushing, pulling, or rotating the portable front lift 14 in a desired direction. The handle 26 may extend upwards and/or outwards from the portable front lift 14 to approximately a waist height for easily grasping. The handle 26 may also include controls thereon or may be shiftable or rotatable with respect to the base structure(s) 20, 22 for controlling various aspects of the portable front lift 14.

Figure 3:
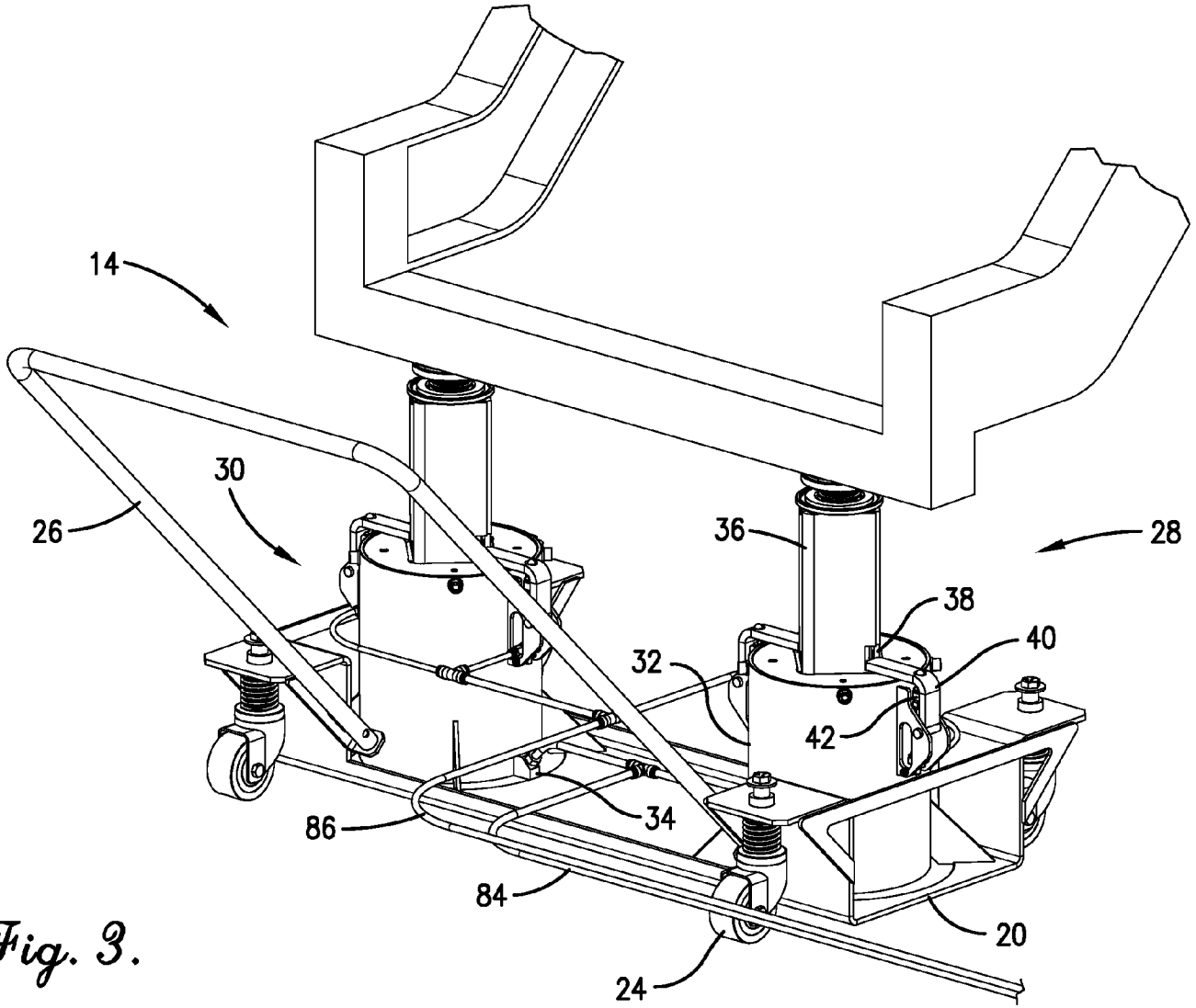
FIG. 3 is a perspective view of the portable front lift of FIG. 1 in an extended position for lifting and supporting the front end of the vehicle.

In an exemplary embodiment, the portable front lift 14 has two lift units 28, 30 for raising the front of the vehicle 12. However, it will be understood that one or more lift units may be used. Because the lift units 28, 30 are essentially the same, only the lift unit 28 will be described. The lift unit 28 is primarily formed of metal such as steel, aluminum, titanium, cast iron, or composite, etc. In one embodiment, the lift unit 28 includes a pneumatic cylinder having a lift base 32 (e.g., a cylinder barrel) and an extensible member 36 (e.g., a piston rod). The lift base 32 includes an air inlet 34 connected to an internal hollow cylindrical chamber (not shown) for receiving compressed air. The extensible member 36 is disposed in the chamber and configured to be urged upward in relation to the lift base 32 from a fully retracted position (FIG. 2) and to engage and lift the front of the vehicle 12 when compressed air is forced into the chamber. The extensible member 36 is configured to lower from a fully extended position (FIG. 3) and to disengage from the front of the vehicle 12 when air is removed from the chamber. Alternatively, the lift unit 28 may be powered by hydraulic power, electrical power, or a combination of pneumatic power, hydraulic power, and/or electrical power.

The extensible member 36 may include a lock-receiving recess 38 such as a slot, a hole, a channel, or an indentation. The lock-receiving recess 38 is configured to receive a mechanical locking member 40 therein when the extensible member 36 is in the extended position. The mechanical locking member 40 is formed of metal such as steel, aluminum, titanium, cast iron, or composite, etc. and is shiftable from an unlocked to a locked position for securing the extensible member 36 in the extended position. In one embodiment, the mechanical locking member 40 is pivotably hinged relative to the base structure(s) 20, 22 and coupled to an actuator 42, such as a pneumatic piston, so that activating the actuator 42 urges the mechanical locking member 40 to pivot to the locked position or the unlocked position.

In the locked position, at least a portion of the mechanical locking member 40 is inserted or urged into the lock-receiving recess 38 to prevent the extensible member 36 from unintentionally lowering to the retracted position. This provides a level of safety such that even in the event of a power failure to the lift unit 28, the vehicle 12 will not descend onto a service technician working under the vehicle 12. To lower the extensible member 36 to the retracted position (for lowering the vehicle 12), the mechanical lock member 40 must be shifted to the unlocked position first. In one embodiment, the extensible member 36 must be raised slightly from the extended position to allow enough space for the mechanical locking member 40 to shift to the unlocked position. This provides an extra layer of safety as it requires the lift unit 28 to be fully functional before unlocking the mechanical lock member 40.

The lift unit 28 has a top portion that is suited for engaging a portion of the front of a frame of the vehicle 12. The top portion may be flat or may have flanges or raised lips for catching edges of the frame and may have a pad made of a high friction material such as rubber for resistively contacting the frame. This helps to prevent the vehicle 12 from slipping in relation to the lift unit 28.

Figure 4:
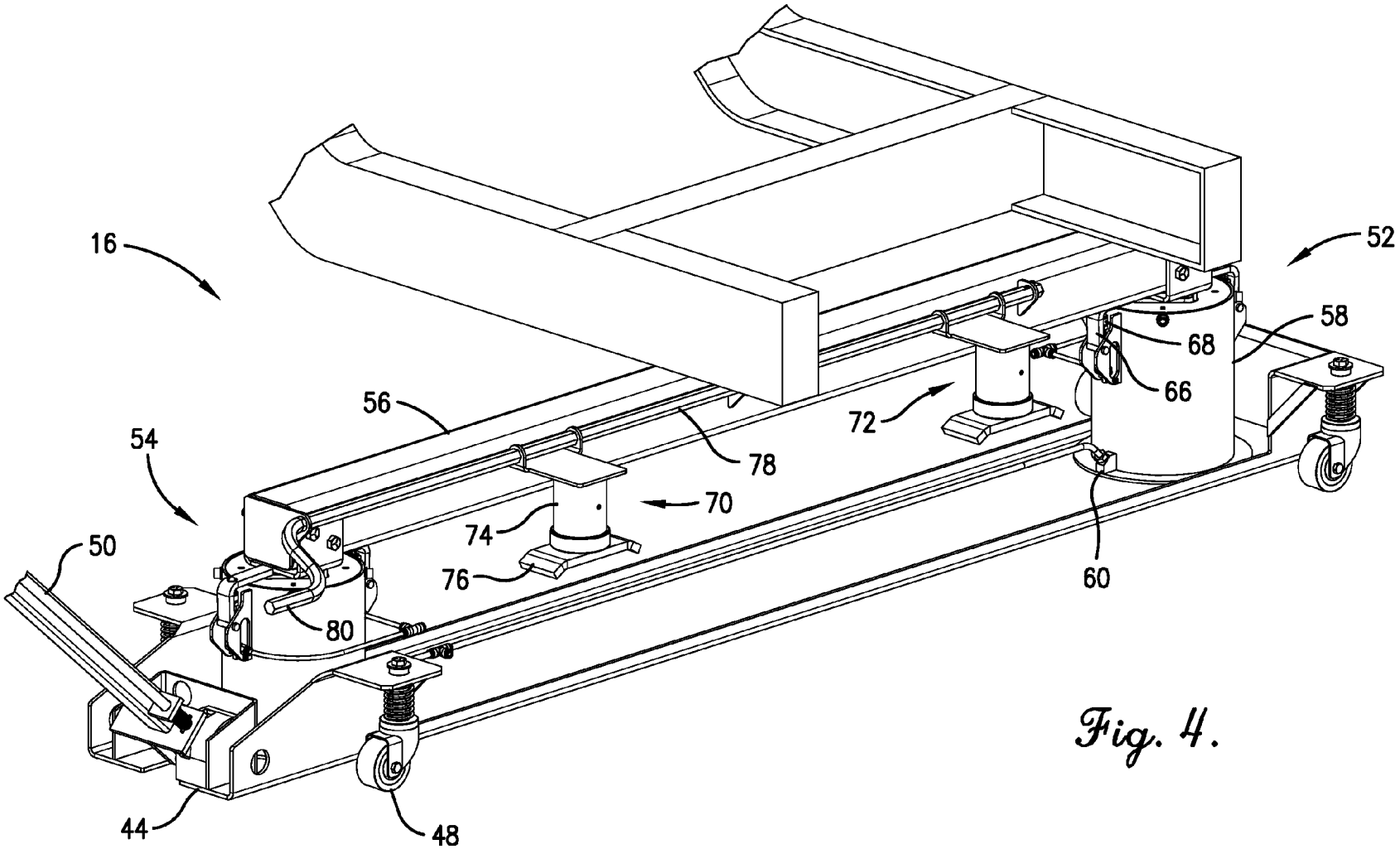
FIG. 4 is a perspective view of the portable rear lift of FIG. 1 in a fully retracted position with vehicle engagement members in a down position for positioning the rear lift under a rear end of the vehicle.
Figure 7:
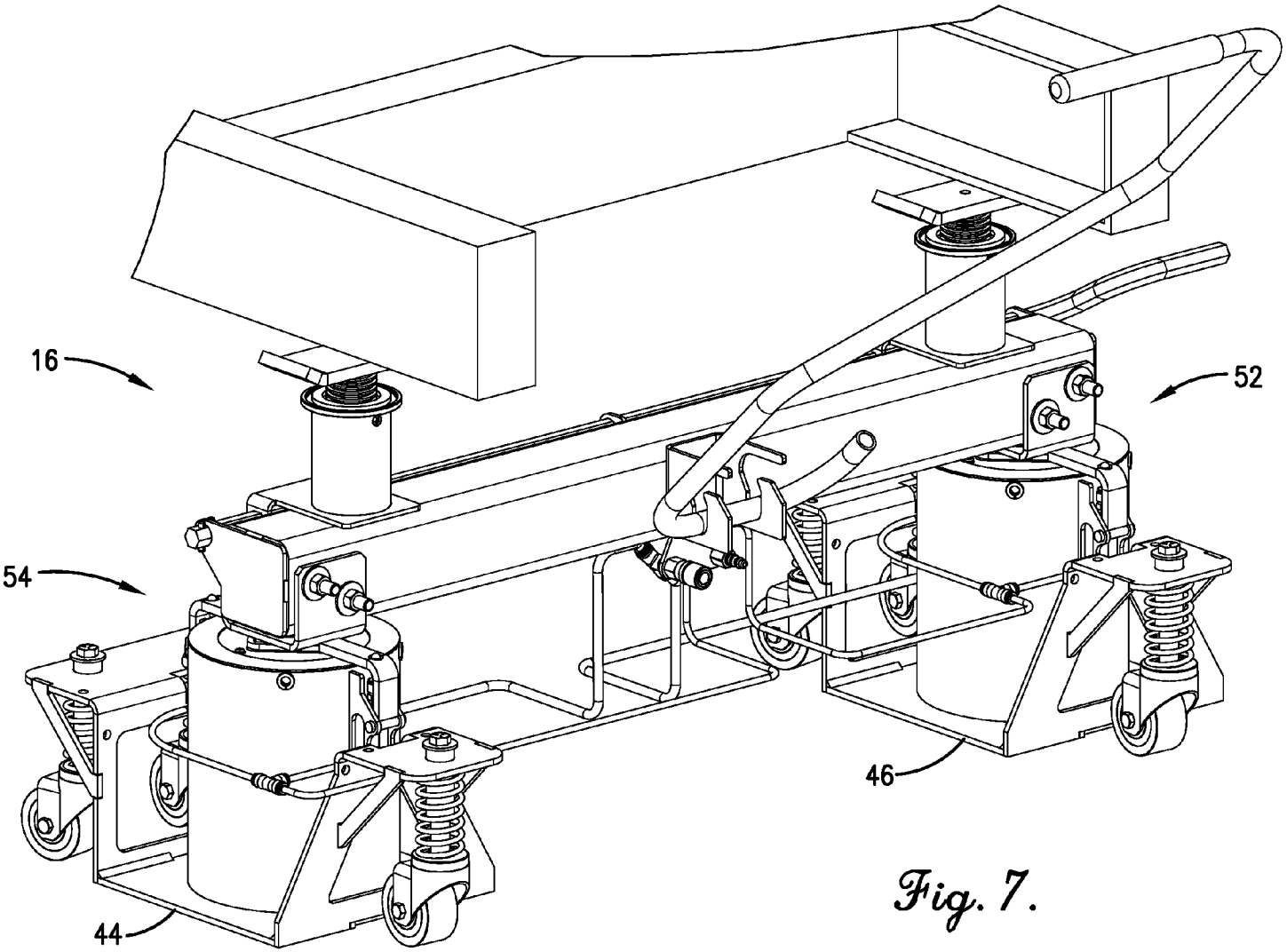
FIG. 7 is a perspective view of another embodiment of the portable rear lift of FIG. 1.

As shown in FIGS. 4 and 7, the portable rear lift 16 includes one or more base structures 44, 46 for easily moving the portable rear lift 16 around the shop floor or other work space. The base structure(s) 44, 46 is supported by a plurality of wheels 48 such as castors for easily positioning the portable rear lift 16 in a proper position and orientation under the vehicle 12. The wheels 48 may be shiftable from a deployed position to a non-deployed position so that the base structure(s) 44, 46 rests firmly on the shop floor. This allows the base structure(s) 44, 46 to provide a sturdy and safe lift point for raising the vehicle 12. The wheels 48 may be urged towards the deployed position by springs or another biasing mechanism. Thus, a force generated by the biasing mechanism must be overcome to shift the wheels 48 to the non-deployed position. The wheels 48 may be lockable in the non-deployed position so that they do not unintentionally shift to the deployed position when the vehicle 12 is being lifted. When the wheels 48 are unlocked, the biasing mechanism urges the wheels 48 to the deployed position. The portable rear lift 16 may also include a handle 50 for easily pushing, pulling, or rotating the portable rear lift 16 in a desired direction. The handle 50 may extend upwards and/or outwards from the portable rear lift 16 to approximately a waist height for easily grasping. The handle 50 may also include controls thereon and may be shiftable, rotatable, or pivotable with respect to the portable rear lift 16 for controlling various aspects thereof. The handle 50 may be pivotally lockable for securing the handle 50 at a desired height or angle. For example, the handle 50 may need to be lowered to clear the body of the vehicle 12 for positioning the portable rear lift 16 under the vehicle 12. The handle 50 or a portion of the handle 50 may be pivoted, rotated, etc. to lock the handle 50 at the appropriate height. The handle 50 may include grips or hand holds for more securely gripping the handle 50.

In the exemplary embodiment, the portable rear lift 16 has two lift units 52, 54 for raising the rear of the vehicle 12. However, it will be understood that one or more lift units may be used. Because the lift units 52, 54 are essentially the same, only the lift unit 52 will be described. In one embodiment, the lift unit 52 includes a pneumatic cylinder formed of metal such as steel, aluminum, titanium, cast iron, or composite, etc. and having a lift base 58 (e.g., cylinder barrel) and an extensible member 62 (e.g., piston rod). The lift base 58 includes an air inlet 60 connected to an internal hollow cylindrical chamber (not shown) for receiving compressed air. The extensible member 62 is disposed in the chamber and configured to be urged upward in relation to the lift base 58 from a fully retracted position (FIG. 4) and to engage and lift the rear of the vehicle 12 when compressed air is forced into the chamber. The extensible member 62 is configured to lower from a fully extended position (FIG. 5) and to disengage from the rear of the vehicle 12 when air is removed from the chamber. Alternatively, the lift unit 52 may be powered by hydraulic power, electrical power, or a combination of pneumatic power, hydraulic power, and/or electrical power.

The extensible member 62 may include a lock-receiving recess 64 such as a slot, a hole, or a channel. The lock-receiving recess 64 is configured to receive a mechanical locking member 66 therein when the extensible member 62 is in the extended position. The mechanical locking member 66 is formed of metal such as steel, aluminum, titanium, cast iron, or composite, etc. and is shiftable from an unlocked to a locked position for securing the extensible member 62 in the extended position. In one embodiment, the mechanical locking member 66 is pivotably hinged relative to the base structure(s) 44, 46 and coupled to an actuator 42, such as a pneumatic piston, so that activating the actuator 42 urges the mechanical locking member 66 to pivot to the locked position or the unlocked position.

In the locked position, at least a portion of the mechanical locking member 66 is inserted or urged into the lock-receiving recess 64 to prevent the extensible member 62 from unintentionally lowering to the retracted position. This provides a level of safety such that even in the event of a power failure to the lift unit 52, the lift unit 52 will not lower and the vehicle 12 will not descend onto a service technician working under the vehicle 12. To lower the extensible member 62 to the retracted position (for lowering the vehicle 12), the mechanical lock member 66 must be shifted to the unlocked position first. In one embodiment, the extensible member 62 must be raised slightly from the extended position to allow enough space for the mechanical locking member 66 to shift to the unlocked position. This provides an extra layer of safety as it requires the lift unit 52 to be fully functional before unlocking the mechanical lock member 66.

Figure 5:
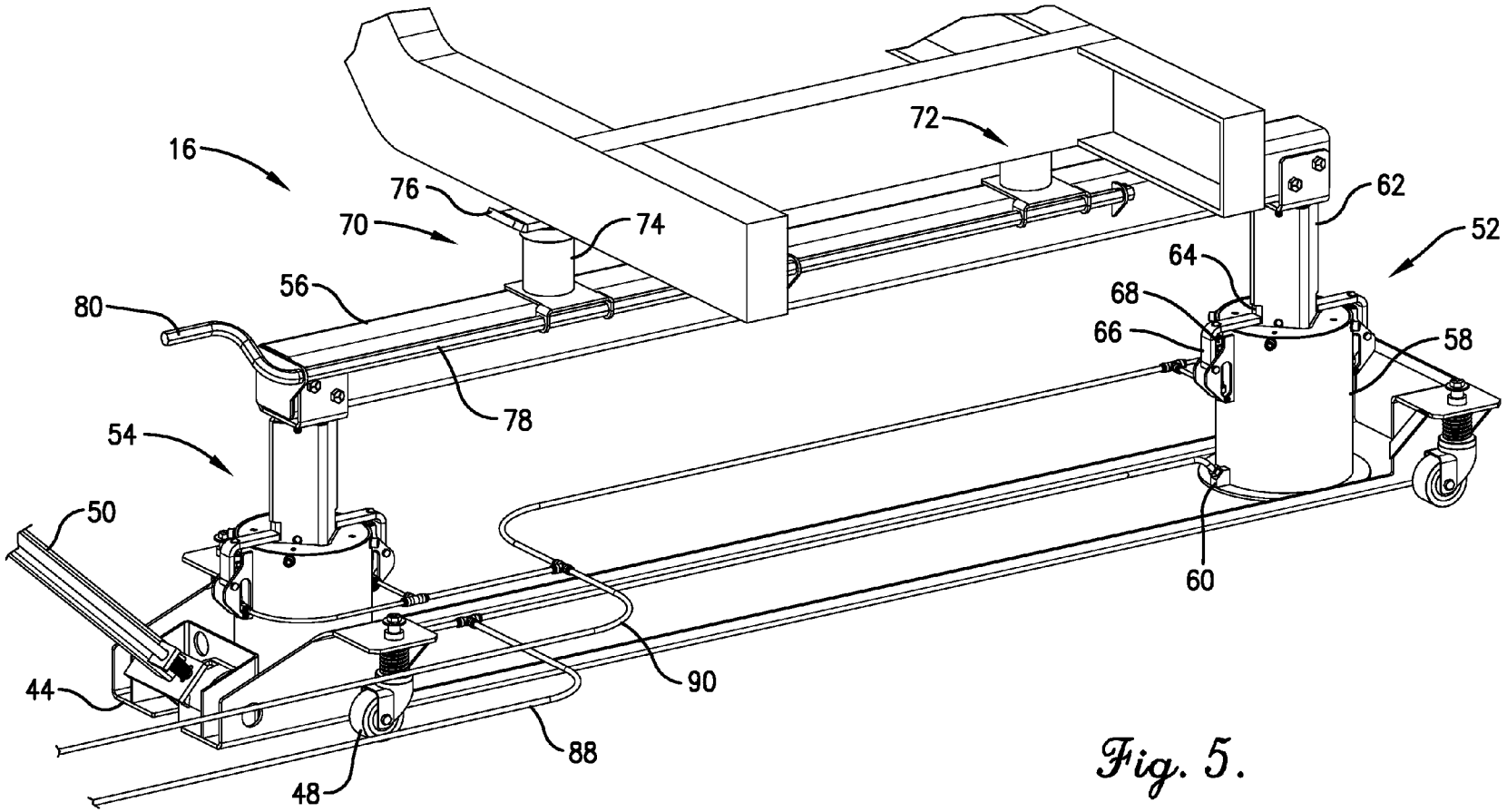
FIG. 5 is a perspective view of the portable rear lift of FIG. 1 in an extended position with the vehicle engagement members in an up position for lifting and supporting the rear end of the vehicle.

The lift units 52, 54 are coupled to a support bar 56 which in turn supports a first and a second vehicle engagement member 70, 72. The support bar 56 is formed of metal such as steel, aluminum, titanium, cast iron, or composite, etc. The first and the second vehicle engagement members 70, 72 are shiftable from a down position (FIG. 4) to an up position (FIG. 5). In the down position, the vehicle engagement members 70, 72 do not extend above an uppermost surface of the support bar 56. This allows the portable rear lift 16 to be moved under the vehicle 12 without contacting the outer body of the vehicle 12, which generally extends lower than the frame of the vehicle 12. The vehicle engagement members 70, 72 translate, pivot, or otherwise shift to the up position at which point they are supported by the support bar 56. For example, the vehicle engagement members 70, 72 may rotate at least 30, 45, 60, or 75 degrees relative to the support bar 56 on a horizontal axis when shifted between the down and the up positions. By pivoting the vehicle engagement members 70, 72 from the down position to the up position, the portable rear lift 16 increases in height by at least 2, 3, 4, 5, or 6 inches.

The vehicle engagement members 70, 72 each have a fixed section 74 and a movable section 76 for further increasing an overall height of the portable rear lift 16. The fixed section 74 and the movable section 76 may be threadedly intercoupled such that rotating the movable section 76 with respect to the fixed section 74 causes the movable section 76 to extend in relation thereto. The movable section 76 may be manually extended or may receive power and control from the control station 18. When extended, the movable section 76 reduces or eliminates any space or slack between the portable rear lift 16 and the vehicle 12 before lifting the vehicle 12. By extending the movable section 76, an overall height of the portable rear lift 16 may increase by at least an additional 2, 3, 4, 5, or 6 inches. The movable section 76 may have a flat uppermost surface or may have flanges or raised lips for catching edges of the frame and may have a pad made of a high friction material such as rubber for resistively contacting the frame. This helps to prevent the vehicle 12 from slipping when lifted. The vehicle engagement members 70, 72 are independently laterally shiftable along the top of the support bar 56. This allows for them to more easily be positioned underneath engagement points of the frame of the vehicle 12 and allows for the portable rear lift 16 to support frames of varying sizes and geometries.

An elongated pivot member 78 connected to the vehicle engagement members 70, 72 and extending near an end of the portable rear lift 16 may be provided for pivoting the vehicle engagement members 70, 72. A service technician can manually rotate the vehicle engagement members 70, 72 by applying a small torque to a lever 80 on the end of the pivot member 78, which in turn pivots the vehicle engagement members 70, 72 between the lowered position and the upright position. Alternatively, the vehicle engagement members 70, 72 may be pivoted and/or extended by pneumatics, hydraulics, or electronics, as described below.

Turning again to FIG. 1, compressed air is supplied to the lifts 14, 16 from a power source 82 such as an air pump or compressed air tank through one or more front pneumatic power lines 84, 86 and rear pneumatic power lines 88, 90, respectively. The power source 82 may have variable output so that the lift units 28, 30, 52, 54 gradually and smoothly lift or lower the vehicle 12. Front pneumatic power line 84 transmits air, and hence, air pressure, to the lift units 28, 30 for providing lifting power thereto. The other front pneumatic power line 86 transmits air to the actuator 42 for activating the mechanical lock member 40. The rear pneumatic power lines 88, 90 transmit air to the lift units 52, 54 and the actuator 68, respectively. The pneumatic power lines 84, 86, 88, 90 may be detached from the lifts 14, 16 and retracted into the control station 18 to clear the work area or for storage.

The pneumatic power lines 84, 86, 88, 90 may include restriction devices 92, 94 for limiting the air pressure applied to the lift units 14, 16. Because the restriction devices 92, 94 are essentially the same, only the restriction device 92 is described. The restriction device 92 limits the output flow of air to not more than 50, 40, 30, 20, or 10% of a minimum flow area upstream from its air inlet (not shown) such that a back-pressure is created upstream from its air inlet. The restriction device 92 may be controlled by inputs from the control station 18 to increase or decrease the percentage of air allowed through the restriction device 92. This allows for smooth and controlled increases and decreases in air pressure applied to the lift units 28, 30, 52, 54. This also helps to prevent the vehicle 12 from being raised unevenly between the front and rear lifts 14, 16. The restriction device 92 may be a one-way restrictor so as to restrict the percentage of air going towards its air inlet without restricting the percentage of air going from its air inlet. The restriction device 92 may have variable output so that the lift units 28, 30, 52, 54 gradually and smoothly lift or lower the vehicle 12.

The portable control station 18 allows for the service technician to control the portable front lift 14 and the portable rear lift 16 from a safe or advantageous position. The portable control station 18 is wheeled and may be moved independently from the portable front lift 14 and the portable rear lift 16 to accommodate different work spaces. The portable control station 18 provides an interface 96 such as a control panel, a dashboard, a controller, a touch screen, etc. and may include levers, buttons, dials, etc. for providing inputs into the vehicle lift system 10. The interface 96 is communicatively or mechanically coupled to the power source 82 and/or the restriction devices 92, 94 for increasing or decreasing lifting power to the lift units 28, 30, 52, 54.

The portable control station 18 may include computing devices and/or databases and may implement a computer program and/or code segments of the computer program to perform some of the functions described herein. The computer program may comprise a listing of executable instructions for implementing logical functions in the user device. The computer program can be embodied in any computer readable medium for use by or in connection with an instruction execution system, apparatus, or device, and execute the instructions. In the context of this application, a "computer readable medium" can be any means that can contain, store, communicate, propagate, or transport the program for use by or in connection with the instruction execution system, apparatus, or device. The computer readable medium can be, for example, but not limited to, an electronic, magnetic, optical, electro magnetic, infrared, or semi conductor system, apparatus, device or propagation medium. More specific, although not inclusive, examples of the computer readable medium would include the following: a portable computer diskette, a random access memory (RAM), a read only memory (ROM), an erasable, programmable, read only memory (EPROM or flash memory), and a portable compact disk read only memory (CDROM), and combinations thereof. The various actions and calculations described herein as being performed by or using the computer program may actually be performed by one or more computers, processors, or other computational devices, independently or cooperatively executing portions of the computer program.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A vehicle lift system comprising:

a portable front lift comprising one or more front lift units and a set of wheels for moving the portable front lift;

a portable rear lift comprising one or more rear lift units and a set of wheels for moving the portable rear lift;

a portable control station for controlling said front and rear lifts, and at least two air supply systems, each configured to supply air from said portable control station to an air inlet of one of said front lift units and said rear lift units, wherein each of said air supply systems comprises a pneumatic restriction device for creating backpressure upstream of said air inlet.

2. The vehicle lift system of claim 1, further comprising one or more front power lines connected to said control station and said front lift, further comprising one or more rear power lines connected to said control station and said rear lift, wherein said front and rear power lines are configured to provide lifting power to said front and rear lift units, respectively.

3. The vehicle lift system of claim 2, wherein said front power lines include at least two front pneumatic lines, wherein said rear power lines include at least two rear pneumatic lines, wherein each of said front lift units comprises a pneumatic cylinder powered by one of said front pneumatic lines and a mechanical lock actuator powered by another of said front pneumatic lines, wherein each of said rear lift units comprises a pneumatic cylinder powered by one of said rear pneumatic lines and a mechanical lock actuator powered by another of said rear pneumatic lines.

4. The vehicle lift system of claim 1, wherein said rear lift comprises at least two of said rear lift units spaced from one another.

5. The vehicle lift system of claim 4, wherein said front lift comprises at least two of said front lift units spaced from one another.

6. The vehicle lift system of claim 4, wherein each of said rear lift units comprises a pneumatic cylinder.

7. The vehicle lift system of claim 4, wherein said rear lift comprises a support bar coupled to and extending between said rear lift units, wherein said rear lift units are configured to raise and lower said support bar.

8. The vehicle lift system of claim 7, wherein said rear lift comprises at least two vehicle engagement members coupled to and supported on said support bar, wherein said vehicle engagement members are shiftable relative to said support bar between a down position and an up position.

9. The vehicle lift system of claim 8, wherein said vehicle engagement members are shiftable between said down and up positions by rotating said vehicle engagement members relative to said support bar on a substantially horizontal axis of rotation, wherein said vehicle engagement members rotate through an angle of at least 30 degrees when shifted between said down and up positions.

10. The vehicle lift system of claim 9, wherein the maximum height of said rear lift is increased by at least 2 inches when said vehicle engagement members are shifted from said down position to said up position.

11. The vehicle lift system of claim 1, wherein each of said front and rear lift units is shiftable between a fully retracted position and a fully extended position, wherein each of said front and rear lift units comprises a shiftable mechanical lock for mechanically locking said lift units in said fully extended position.

12. A portable vehicle lift comprising:

at least two spaced-apart lift units; a support bar coupled to and extending between said lift units; and at least two spaced-apart vehicle engagement members coupled to and supported on said support bar, wherein said vehicle engagement members are connected to an elongated pivot member extending along a substantially horizontal axis of rotation, such that said vehicle engagement members are rotatable, via said pivot member, relative to said support bar between a down configuration and an up configuration.

13. The portable vehicle lift of claim 12, wherein said vehicle engagement members rotate through an angle of at least 30 degrees when shifted between said down and up positions.

14. The portable vehicle lift of claim 12, wherein the maximum height of said lift is increased by at least 2 inches when said vehicle engagement members are shifted from said down position to said up position.

15. The portable vehicle lift of claim 12, wherein said vehicle engagement members rotate through an angle of at least 30 degrees when shifted between said down and up positions, and wherein the maximum height of said lift is increased by at least 2 inches when said vehicle engagement members are shifted from said down to said up positions.

16. The portable vehicle lift of claim 12, wherein said pivot member includes a lever for causing the pivot member and the vehicle engagement members to rotate between down and up positions.

17. The portable vehicle lift of claim 12, wherein each of said lift units comprises:

a lift base;

a vertically extensible member coupled to said lift base and shiftable relative to said lift base between a retracted position and an extended position, wherein said extensible member defines one or more lock-receiving recesses;

one or more mechanical lock members coupled to said lift base and shiftable relative to said lift base between a locked position and an unlocked position, wherein when said mechanical lock members are in said locked position said mechanical lock members are received in said lock-receiving recesses of said extensible member; and one or more actuators for shifting said mechanical lock members between said locked and unlocked positions.

18. The portable vehicle lift of claim 17, wherein shifting of said extensible member is powered by pneumatic power, pneumatic/hydraulic power, hydraulic power, and/or electrical power.

19. The portable vehicle lift of claim 12, wherein each of said vehicle engagement members comprises a fixed section and a moveable section, wherein said fixed section comprises a base member supported on a top surface of said support bar when said vehicle engagement members are in said up configuration, wherein said moveable section is configured for extension relative to said base member.

20. The portable vehicle lift of claim 19, wherein said fixed section and said moveable section are threadedly intercoupled so that rotation of said moveable section relative to said fixed section causes extension or retraction of said moveable section relative to said fixed section.

21. The portable vehicle lift of claim 12, wherein said lift units are pneumatic lift units configured to be powered by compressed air from a common compressed air source, each of said pneumatic lift units comprising an air inlet for receiving compressed air used to power said lift units.

22. The portable vehicle lift of claim 21, further comprising:

at least two air supply systems, each configured to supply air from said common compressed air source to said air inlet of one of said pneumatic lift units, wherein each of said air supply systems comprises a pneumatic restriction device for creating backpressure upstream of said air inlet.

23. The portable vehicle lift of claim 22, wherein said pneumatic restriction device defines a restricted flow area that is not more than 50 percent of a minimum flow area of said air supply system upstream of said pneumatic restriction device.

24. The portable vehicle lift of claim 22, wherein said pneumatic restriction device is a one-way restriction device configured to restrict the flow of air towards said air inlet but not restrict the flow of air away from said air inlet.

25. A portable vehicle lift unit comprising:

a lift base;

a vertically extensible member coupled to said lift base and shiftable relative to said lift base between a retracted position and an extended position, wherein said extensible member defines one or more lock-receiving recesses;

one or more mechanical lock members coupled to said lift base and shiftable relative to said lift base between a locked position and an unlocked position, wherein when said mechanical lock members are in said locked position said mechanical lock members are received in said lock-receiving recesses of said extensible member;

one or more actuators for shifting said mechanical lock members between said locked and unlocked positions; and a control system for automatically shifting said mechanical lock members into said locked position when said extensible member is in said extended position, wherein shifting of said extensible member and of said mechanical lock members are powered by a common pneumatic power source.

26. The portable vehicle lift unit of claim 25, wherein said lift unit comprises a pneumatic cylinder having a cylinder barrel and a piston rod, wherein said lift base comprises said cylinder barrel and said extensible member comprises said piston rod.

27. The portable vehicle lift unit of claim 25, wherein said at least one mechanical lock member pivots about a pivot point when shifted between said locked and unlocked positions.

28. The portable vehicle lift unit of claim 27, wherein said at least one mechanical lock member includes a distal end for engaging said extensible member, said distal end configured to be movable only in a generally upward direction as a result of pivoting of said at least one mechanical lock member about said pivot point when said at least one mechanical lock member is in said locked position, so that said extensible member must extend vertically from said extended position before said mechanical lock member can pivot from said locked position.

29. A method of lifting a vehicle, said method comprising:

(a) positioning a portable lift under a vehicle, wherein said portable lift comprises at least two lift units, a support bar coupled to and extending between said two lift units, and one or more vehicle engagement members coupled to said support bar, wherein said vehicle engagement members are connected to an elongated pivot member extending along a substantially horizontal axis of rotation such that said vehicle engagement members are rotatable between a down configuration and an up configuration;

(b) while said portable lift is under said vehicle, rotating said pivot member, such that said vehicle engagement members are rotated upward relative to said support bar from a down position to an up position;

(c) while said vehicle engagement members are in said up position, shifting a contact member of said engagement members into contact with the frame of said vehicle; and (d) using said lift units to raise at least a portion of said vehicle.

30. The method of claim 29, wherein said pivoting of step (b) causes said contact member to shift from a first position lower than an uppermost surface of said support bar to a second position higher than the uppermost surface of said support bar.

31. The method of claim 29, wherein said pivoting of step (b) includes manually rotating the elongated pivot member coupled to said engagement members.

32. The method of claim 29, further comprising shifting a movable section of said vehicle engagement members relative to a fixed section of said vehicle engagement members.

33. The method of claim 29, wherein said portable lift comprises two of said lift units and two of said vehicle engagement members.

34. The method of claim 29, wherein said portable lift is a portable rear lift and said positioning of step (a) includes positioning said rear lift under a rear portion of said vehicle and further comprises positioning a portable front lift under a front portion of said vehicle, wherein step (d) includes simultaneously actuating said front and rear lifts to thereby simultaneously raise the front and rear portions of said vehicle.

* * * * *